US006845957B2

(12) United States Patent
Schworer

(10) Patent No.: US 6,845,957 B2
(45) Date of Patent: Jan. 25, 2005

(54) DEVICE FOR MOUNTING AND DISMANTLING FORMWORK

(75) Inventor: Artur Schworer, Senden (DE)

(73) Assignee: Peri GmbH (DE)

( * ) Notice: Subject to any disclaimer, the term of this patent is extended or adjusted under 35 U.S.C. 154(b) by 0 days.

(21) Appl. No.: 10/393,266

(22) Filed: Mar. 20, 2003

(65) Prior Publication Data

US 2003/0209648 A1 Nov. 13, 2003

(30) Foreign Application Priority Data

Mar. 22, 2002 (DE) ..... 102 12 747

(51) Int. Cl.[7] ..... E04G 11/18; B28B 7/30
(52) U.S. Cl. ..... 249/38; 249/180; 249/193
(58) Field of Search ..... 249/36, 37, 38, 249/193, 180, 185

(56) References Cited

U.S. PATENT DOCUMENTS

| | | | | |
|---|---|---|---|---|
| 1,042,749 A | * | 10/1912 | Atterbury | 249/180 |
| 1,711,963 A | * | 5/1929 | Perry | 249/180 |
| 3,822,853 A | * | 7/1974 | Shelley | 249/27 |
| 4,055,321 A | * | 10/1977 | Schimmel | 249/182 |
| 4,447,035 A | * | 5/1984 | Ivey et al. | 249/194 |
| 4,519,570 A | * | 5/1985 | Strickland et al. | 249/194 |
| 4,650,150 A | * | 3/1987 | Pacheco-Pifano | 249/19 |
| 5,788,874 A | * | 8/1998 | Tucker, Jr. | 249/180 |

FOREIGN PATENT DOCUMENTS

| | | |
|---|---|---|
| DE | 6922176 | 6/1969 |
| DE | 7428898 | 12/1974 |
| DE | 28 15 846 C2 | 10/1981 |
| FR | 1123841 | 9/1956 |

OTHER PUBLICATIONS

Doka Die Schalungstechniker "Doka–Produktregister, Ein Ubersicht Uber Alle Teile Des Doka–Schalungsprogrammes", Broschure Agusgabe 1993.

* cited by examiner

*Primary Examiner*—Michael Safavi
(74) *Attorney, Agent, or Firm*—Walter A. Hackler

(57) ABSTRACT

A compensating element (23) is permanently connected to a first formwork element (21) and a second formwork element (22) wherein the compensating element (23) has openings formed like elongated holes on the side along its axial direction through each of which one tube penetrates which terminates in one housing each on both sides of the compensating element (23). The housings can be displaced along the tube and be moved via a rod assembly. When the compensating element (23) is displaced into a formwork dismantling position, the formwork elements (21, 22) and the compensating element (23) are released from the concrete surface and the entire device can be moved (FIG. 2).

6 Claims, 9 Drawing Sheets

DEVICE FOR MOUNTING AND DISMANTLING FORMWORK

The invention concerns a device for mounting and dismantling of at least one formwork element, consisting of a compensating element which can be connected to a first and second formwork element and comprising means for pulling together or pushing apart the first and second formwork elements over a certain distance.

A device of this type is disclosed by a Framax formwork dismantling element of the company Doka Industrie GmbH, Amstetten (AT).

The known formwork dismantling element is a special element for dismantling formwork of inner shafts, e.g. a shaft for an elevator to be concreted. The known formwork dismantling element permits displacement of the entire formwork after a section has been concreted. When a concrete work process is finished, the formwork elements which are connected with the formwork dismantling element, are pulled together via a builder's winch. If the inner shaft to be concreted has a square or rectangular cross-section, the formwork elements are pulled together at all four inner sides after the walls to be concreted have hardened, and the perimeter of the total formwork is reduced that much that it can be lifted out of the concreted shaft section as a total unit, e.g. via a crane.

If the known inner shaft formwork is to be dismantled, the overall adhesive force of the formwork elements on each inner side with which they adhere to the concreted wall, must be abruptly overcome. This produces large peaks of force which must be met and overcome by the builder's winch. When the known inner shaft formwork is reduced in size, the inserted formwork material is subjected to large stress when the static friction is overcome at the transition into sliding friction. The formwork material to be reduced in size is displaced parallel to a concreted wall.

In another known shaft formwork (Meva) which his known from prior art, the inner shaft formwork comprises eight corner joints, e.g. when the shaft has a square cross-section, which permit pulling together in the form of a star (reduction in size) of the inner shaft formwork after a section has been concreted. The inner shaft formwork is enlarged to a concreting position and stabilized via directional struts (e.g. threaded spindles), and for dismantling the formwork, the overall inner shaft formwork is pulled together in the form of a star and thereby reduced in size so that the inner shaft formwork can be removed from the concreted shaft with a crane. The inner shaft formwork comprising a plurality of joints can reach the dismantling position with little force since the formwork elements are peeled off step by step from the concreted walls. The overall construction of the known joint inner shaft formwork, however, is more demanding than the conventional first-mentioned inner shaft formwork, and only in a few regions, e.g. a Halfen anchor rail can be nailed to the inner shaft formwork, which consists mainly of metal. When the joint inner shaft formwork is in the state of reduced size, the corner joints are in rigid contact with the concreted corners of the inner shaft and the required directional struts must be adjusted to the size of the shaft to be concreted.

It is the object of the invention to facilitate the handling of known devices to permit rapid enlargement or reduction in size, i.e. dismantling, of the formwork with little effort and to prevent peaks of force during dismantling of the formwork which act on the formwork elements.

This object is achieved in accordance with the invention in that the compensating element and/or the bordering formwork element have third means which displace, during displacement of the compensating element into a dismantling position, the formwork surface of the first and/or second formwork element at least partially behind the formwork surface of the compensating element, that the compensating element and/or the bordering formwork element comprise fourth means which, during displacement of the compensating element into a dismantling position, pull together the first and/or second formwork element behind the formwork surface of the compensating element and that the compensating element and/or the bordering formwork element comprise means which, during displacement of the compensating element into a formwork mounting position relative to the first and/or second formwork element, move apart the formwork element/s into a predetermined formwork position.

The inventive device has the essential advantage that the entire formwork surface is flat and can be formed by formwork elements which have a wooden formwork shell. E.g., a Halfen rail can therefore be nailed to several positions in a completely flat fashion. During dismantling of the formwork, the entire inventive formwork, provided that is an inner shaft formwork, can be removed from the inner walls of the concreted shaft via a chained suspension with a crane by simultaneous lifting of the compensating elements, e.g. four compensating elements if the shaft has a square cross-section. The formwork elements are removed from the concreted walls in a first dismantling step by the lifting process and are pulled together in a second dismantling step to such an extent that the entire inventive inner shaft formwork can be lifted out of the concreted shaft section.

If the inventive inner shaft formwork is reduced in size, it still resiliently abuts the concreted walls of the inner shaft through the formwork surfaces of the compensating elements through a touching contact and can be lifted out of the concrete shaft section in a guided fashion. The compensating element and/or the bordering formwork element preferably comprise first means which displace the formwork surface of the compensating element facing the formwork plane behind the formwork surface of the first and/or second formwork element during displacement of the compensating element into a dismantling position, and the compensating element and/or the bordering formwork element have second means which displace the formwork surface of the compensating element into the plane of the formwork surface of the first and/or second formwork element during displacement of the compensating element into a dismantling position.

In a further embodiment of the invention, the compensating element is formed in the shape of a pillar comprising several openings along its axial direction which extend transverse to its axial direction, and comprises the formed formwork surface facing the formwork surface and, on the surface opposite to the formwork surface, the compensating element has several superposed openings, e.g. for engagement of a tool.

This is advantageous in that the compensating element abuts the wall to be concreted only along a small width. It can therefore be removed, i.e. peeled off, ripped off from the concreted wall with little force. With the aid of a Halfen rail, only a small flat surface must be bridged which extends between two bordering formwork elements to which the Halfen rail can be mounted. If the formwork surface of the compensating element is made of metal, it is not suited for nailing. The compensating element can be permanently connected to bordering formwork elements via the openings, and the openings formed on the rear side of the compensating element permit, if required, displacement of the compensating elements relative to the formwork elements through crow bars in case this is not already automatically possible through acting gravity.

The inventive device can also be used in vaults or at any location where formwork must be reduced or enlarged in size.

In a further embodiment of the invention, the openings are formed as crank guidances of the type of an elongated hole which are each penetrated by a tube which is displaceably guided in a housing on both sides of the compensating element each. The housing is stationarily connected to the bordering formwork elements, wherein additionally a rod assembly is hinged to the housing and the compensating element.

This is advantageous in that through an axial displacement motion of the compensating element relative to the formwork element(s), depending on the shape of the crank contour, the compensating element can be displaced more or less far relative to the formwork element(s) along the crank and transverse to the axial direction of the compensating element. If e.g. for an inner shaft formwork, the compensating element with coupled formwork elements is lifted, the crank of the compensating element is displaced from a first end position (encased state, concreting can start) on the stationary tube to a second end position (all formwork elements are removed from a concreted wall and disposed at a distance therefrom) of the crank and the compensating element can be displaced relative to the formwork elements or inversely transverse to the direction of the lifting motion, depending on the design, shape, and length of the crank.

If the formwork elements are supported on the concreted surface, the compensating element can be removed from the concreted surface via a crank of corresponding design and assumes a position at a distance from the concreted surface. In this position, the formwork surface of the compensating element is spaced apart from the concreted surface.

If, while lifting the compensating element, the formwork surface of the compensating element exerts a force onto the concreted surface since the crank is formed corresponding to the stationary tube mounted to the formwork element(s), then the formwork elements bordering the compensating element can be peeled off from the concreted surface step by step, depending on the lifting height of the compensating element. The amount of the peeled-off surface of the formwork element(s) is determined by the length of the crank recess viewed in a vertical direction.

If the crank is in the second end position in which the compensating element can no longer be displaced relative to the tube mounted to the formwork element(s), during further lifting of the compensating element, the formwork element (s) connected to the compensating element is/are lifted as well. For this reason, the formwork elements are pulled together in the direction towards the respective compensating element before formwork elements connected to the compensating element are lifted through lifting of the compensating element. During this motion, the formwork elements are completely removed from the concreted surface. The formwork surfaces of the formwork elements are peeled off from the concreted surface and subsequently pulled together behind the compensating element via the hinged rod assembly. The formwork surfaces of the formwork elements are in a set back position relative to the formwork surface of the compensating element during pulling together. Peaks of force for overcoming of large-surface adhesive forces between the formwork elements and the concreted surface are prevented since the formwork elements are either completely or mostly peeled off from the concreted surface before reduction in size or displacement of the formwork elements at a slight angle relative to the concreted surface.

The rod assembly is preferably designed such that during motion of the compensating element into a dismantling position, the formwork element(s) is/are pulled together only when the formwork element(s) has/have been peeled off from the concreted surface by at least 40% of their formwork surface. This measure facilitates dismantling of formwork elements and during pulling together of the formwork elements, there are no considerable adhesive forces between concreted wall and the formwork elements which might have to be overcome.

Moreover, the upper end of a compensating element is preferably provided with a bracket having an opening. This is advantageous in that for inner shaft formworks, the compensating elements can be moved in a simple fashion via a chained suspension by a crane. This bracket also permits connection of several compensating elements disposed on top of each other. This measure permits handling of higher sections to be concreted.

To produce a square or rectangular inner shaft, the invention provides an inner shaft formwork of four corner formwork elements which are connected to further formwork elements which each adjoin a compensating element approximately at the center of a shaft wall to be concreted such that four compensating elements are formed which face each other.

This has the advantage that all four compensating elements can be simultaneously lifted with a chained suspension via a crane during dismantling of an inner shaft formwork, and during lifting, the formwork surfaces of the compensating elements can be removed from the concreted surface and the peeling off of the formwork surfaces of the formwork elements and the corner formwork elements as well as the reduction in size or pulling together of the formwork surfaces to a reduced perimeter takes place, which produces a gap between the formwork surfaces and the respective concreted wall. The compensating elements resiliently contact the concreted surface such that the overall inner shaft formwork can be lifted thereby being guided on all sides.

The hinging and/or the connection of the housings with the bordering formwork elements have enough play such that when the formwork is completely dismounted, the formwork elements and compensating elements can be inclined in a slightly concave inward direction relative to the flat concreted surface, viewed from one formwork corner to the other formwork corner. So the inventive inner shaft formwork, which slightly yields under pressure, can be transferred.

It is clear that in connection with the inventive inner shaft formwork, also an outer shaft formwork must be erected for building a shaft, wherein the outer shaft formwork may have a conventional design. If the compensating element of the inventive device is displaced relative to a bordering formwork element, this displacement effects arrangement displacements of the compensating elements or formwork elements relative to a plane which forms formwork surfaces of the compensating elements and formwork elements. The formwork surfaces of the compensating elements and of the formwork elements can be disposed in one plane or can be mutually offset during these displacements.

It is clear that the inventive idea can be completely solved with the mounting and dismantling device through initially peeling off and pulling together the bordering formwork elements from the concreted surface during a dismantling process thereby lifting the entire device. This is possible since the surface adhering to the concreted surface via the compensating element is opposite to the surfaces adhering on the concrete surface via the formwork elements.

Further advantages can be extracted from the description and the enclosed drawing. The features mentioned above and below can be used in accordance with the invention either individually or in any arbitrary combination. The embodiments mentioned are not to be understood as exhaustive enumeration but rather have exemplary character. The invention is shown in more detail in the drawing with reference to embodiments.

Figure 9:
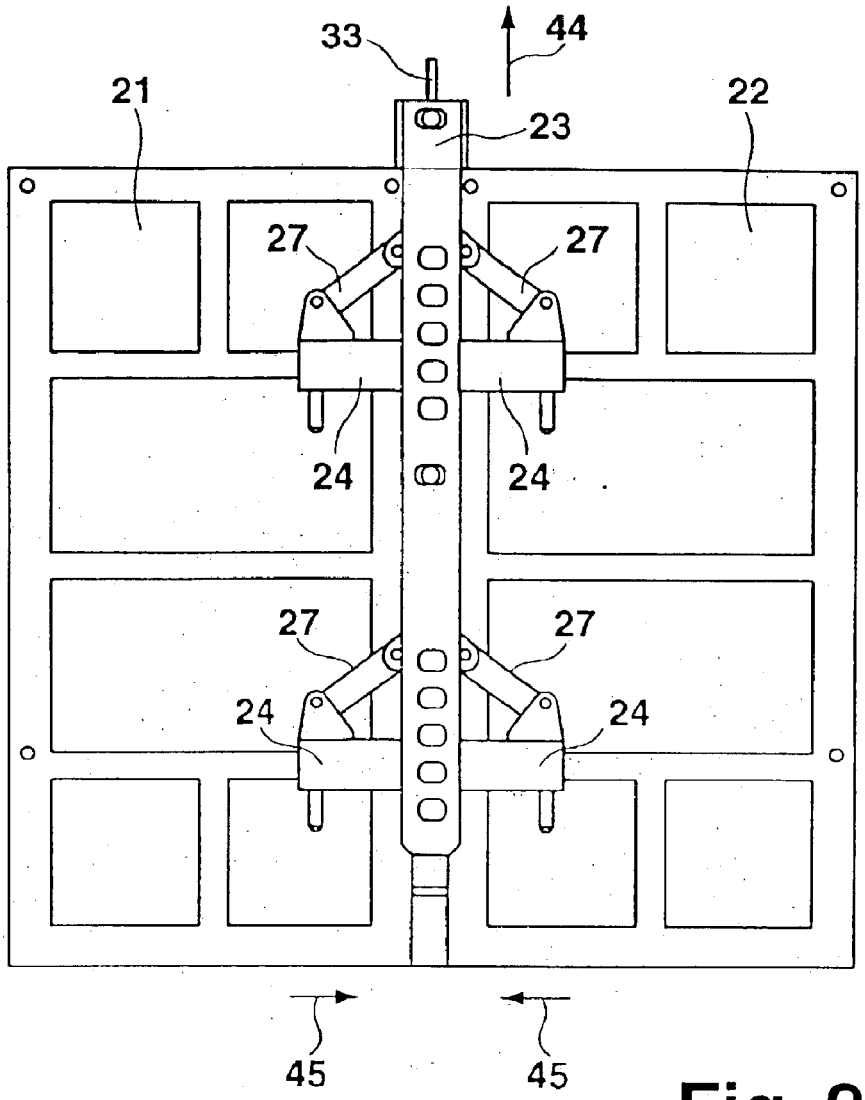
Figure 10:
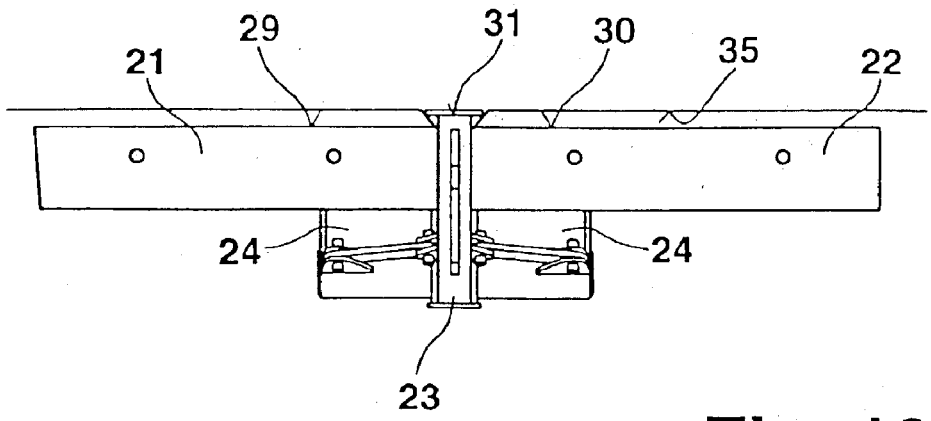
Figure 11:
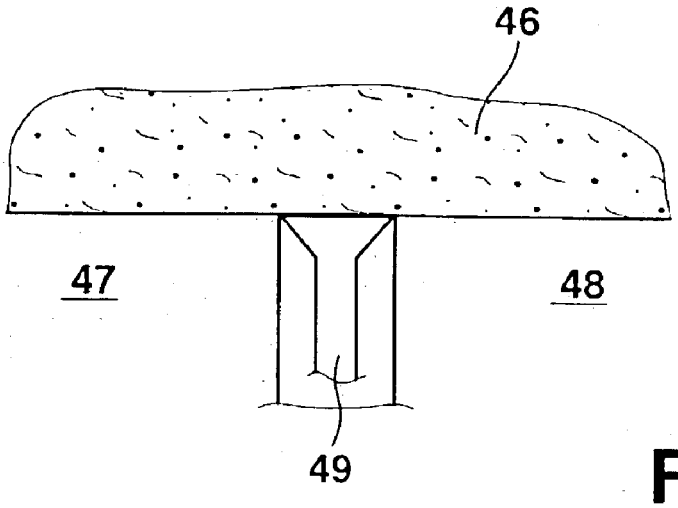
Figure 12:
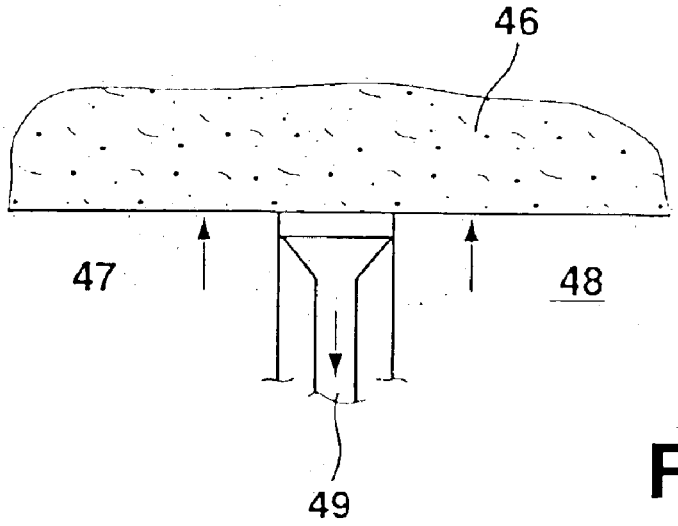
Figure 13:
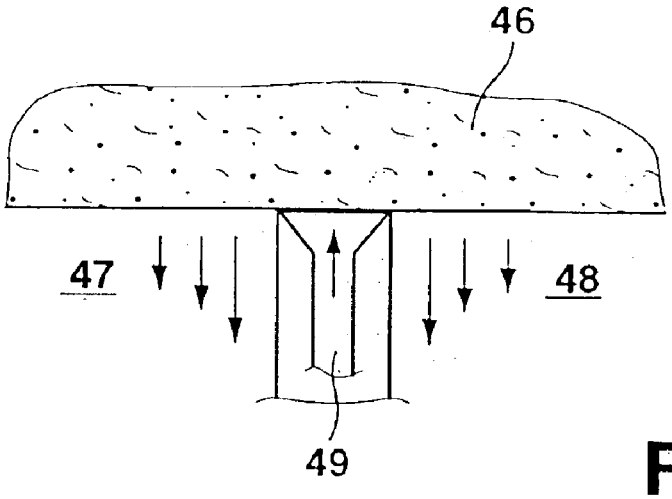
Figure 14:
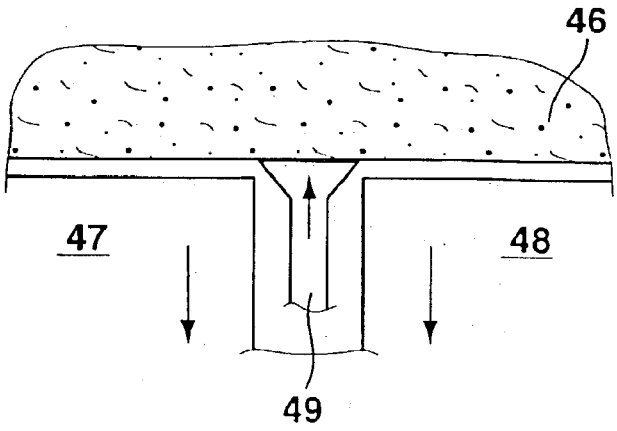
Figure 15:
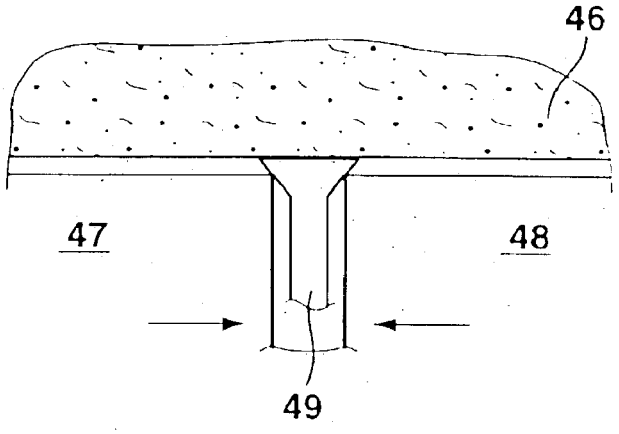
Figure 16:
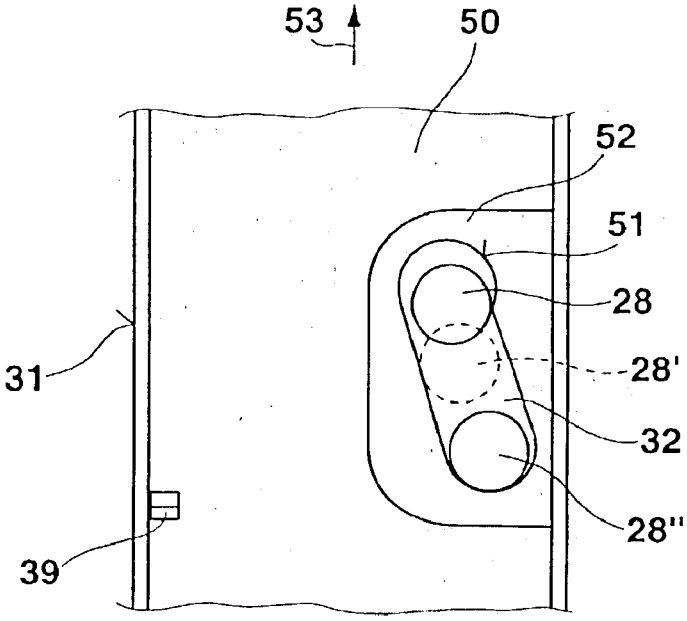

FIG. 9 shows a rear view of an inventive device with a compensating element and a first and second formwork element wherein the compensating element shows the completely dismantled position, in which the formwork elements are pulled together behind the formwork surface of the compensating element and the formwork surfaces of the formwork elements are set back relative to the formwork surface of the compensating element;

FIG. 10 shows a top view onto the inventive device of FIG. 9;

FIG. 11 shows a function diagram of the inventive device in a top view with highly schematized representation of a concreted wall, a compensating element and a first and second formwork element in a state in which the formwork is mounted;

FIG. 12 shows a function diagram like FIG. 11 wherein dismantling of the formwork is started and the formwork surface of the compensating element is removed from the concreted surface;

FIG. 13 shows a function diagram like FIG. 11 with a formwork dismantling process subsequent to FIG. 12 wherein the formwork surface of the compensating element is supported on the concreted surface and pushes away the first and second formwork elements from the concreted wall;

FIG. 14 shows a function diagram like FIG. 11 with a formwork dismantling process subsequent to FIG. 13 wherein the formwork surfaces of the first and second formwork elements are peeled off and separated from the concreted surface;

FIG. 15 shows a function diagram like FIG. 11 with a formwork dismantling process subsequent to FIG. 14, wherein the first and second formwork elements are pulled together behind the formwork surface of the compensating element;

FIG. 16 shows a section of a side view of a compensating element in the region of one of a plurality of openings with one of the numerous possible crank contour designs.

The description of the figures shows embodiments wherein the inventive device is used as inner shaft formwork. In this connection, the front view of all elements is defined such that they show the formwork surface.

Figure 1:
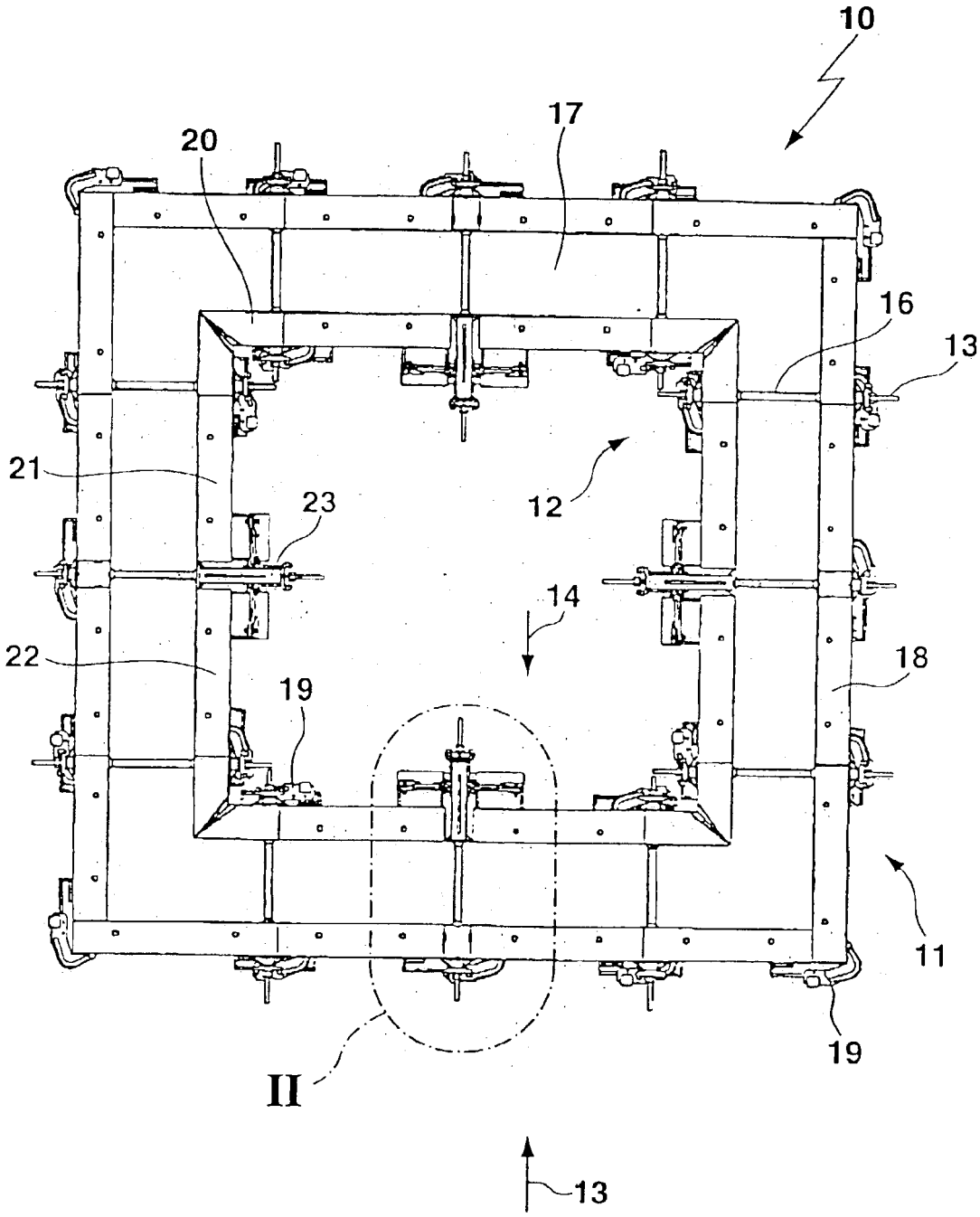
FIG. 1 shows a top view onto an inventive device which is used as shaft formwork in the encased state of the formwork.

Reference numeral 10 in FIG. 1 shows a top view of a shaft formwork which is composed of an outer shaft formwork 11 and an inner shaft formwork 12. The viewing direction of the front view is indicated by reference numeral 13, and 14 designates the viewing direction of the rear view. The outer shaft formwork 11 is held together with the inner shaft formwork 12 via anchoring rods 15. The anchoring rods 15 are guided in jacket tubes 16 between the outer shaft formwork 11 and the inner shaft formwork 12. FIG. 1 shows the shaft formwork 10 in the mounted state wherein the outer shaft formwork 11 defines together with the inner shaft formwork 12 a free space 17 which can be filled with reinforcing material and concrete.

The outer shaft formwork 11 is composed of formwork elements 18 which are rigidly held together by turnbuckles 19.

The inner shaft formwork 12 is composed of corner formwork elements 20, first formwork elements 21, second formwork elements 22 and compensating elements 23. The formwork elements of the inner shaft formwork 12 are likewise rigidly interconnected via turnbuckles 19 and the compensating elements 23 are permanently connected to the bordering first and second formwork elements 21, 22 via a housing which is part of the compensating elements 23 and is described in more detail below.

Figure 2:
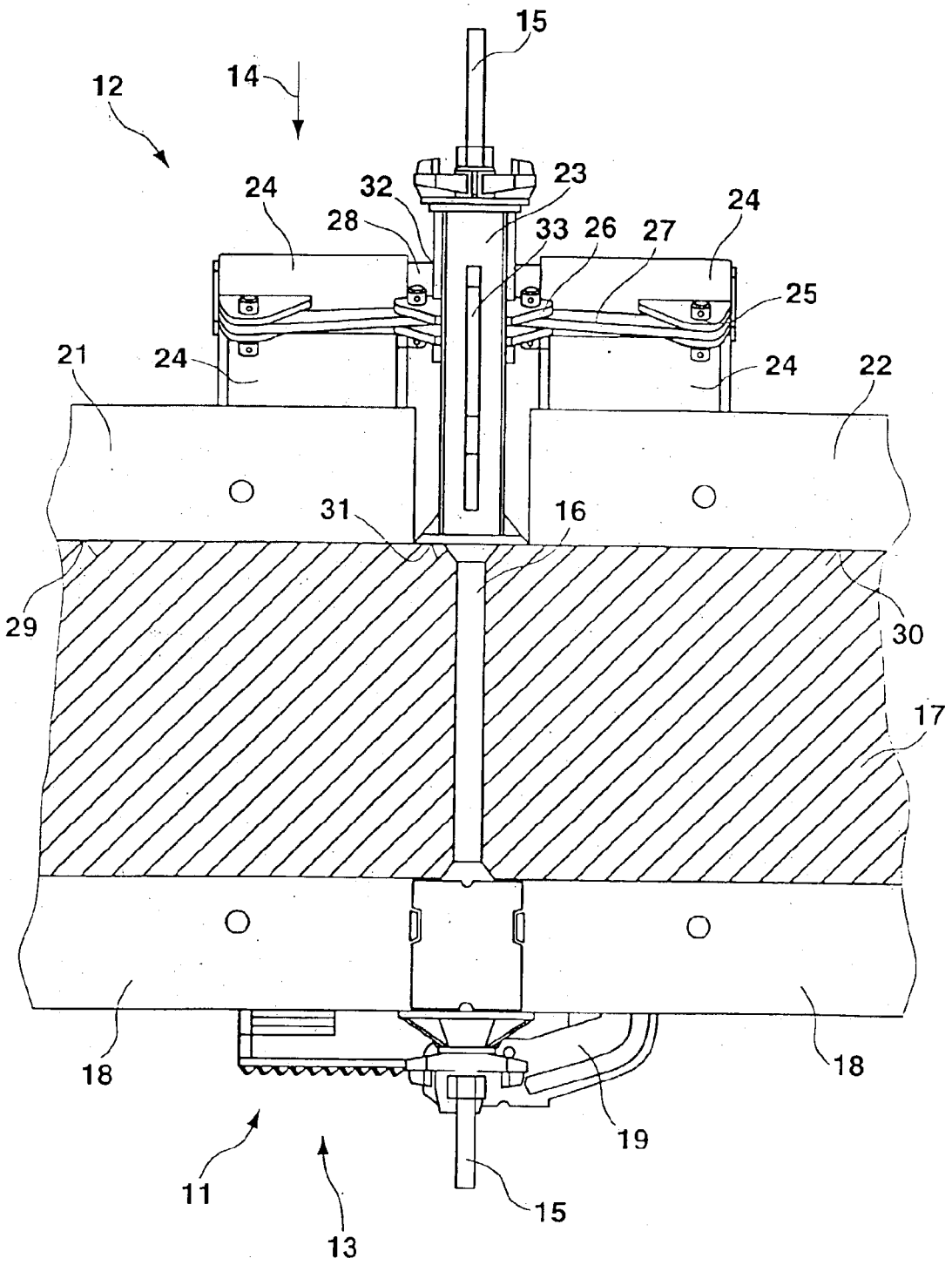
FIG. 2 shows a sectional enlargement of FIG. 1 in the region II with an inventive compensating element.

II delimits with dash-dotted lines a section of the shaft formwork 10 which is shown on an enlarged scale in FIG. 2.

FIG. 2 shows a section II of FIG. 1 on an enlarged scale. Parts of the formwork elements 18 of the outer shaft formwork 11 are shown which are held together by a turnbuckle 19. The viewing directions for a front view and a rear view are indicated with reference numerals 13 and 14. Through the formwork elements 18, an anchoring rod 15 is guided via which the outer shaft formwork 11 is held together with the inner shaft formwork 12. The anchoring rod 15 is guided in the free space 17 in a jacket tube 16 and penetrates the compensating element 23 on the side of the inner shaft formwork 12.

The compensating element 23 is permanently connected to the first formwork element 21 and the second formwork element 22 via a housing 24. A first coupling 25 is formed on the housing 24 and a second coupling 26 is provided on the compensating element 23, and a rod assembly 27 connects the two couplings 25, 26 in an articulated fashion. The housing 24 which is formed on both sides of the compensating element 23 holds a tube 28 with respect to which the housings 24 can be displaced via the rod assembly 27.

The first formwork element 21 forms a formwork surface 29, the second formwork element 22 forms a formwork surface 30, and the compensating element 23 comprises a formwork surface 31 wherein the formwork surfaces 29, 30, 31 in the mounted state of the formwork form a flat surface, a formwork surface, which directly borders a surface to be concreted.

The tube 28 penetrates the compensating element 23 in an opening 32, having the shape of an elongated hole, formed in the compensating element 23. When the compensating element 23 is moved out of the plane of the drawing via a bracket 33 into which e.g. the hook of a crane can engage, the tube 28 can be displaced in the opening 32, having the shape of an elongated hole, along the opening 32. During this motion, the first and second formwork elements 21, 22 remain initially stationary until the tube 28 is displaced into an intermediate position of the opening 32 having the shape of an elongated hole in which removal of the formwork elements 21, 22 from the concrete surface is triggered.

Figure 3:
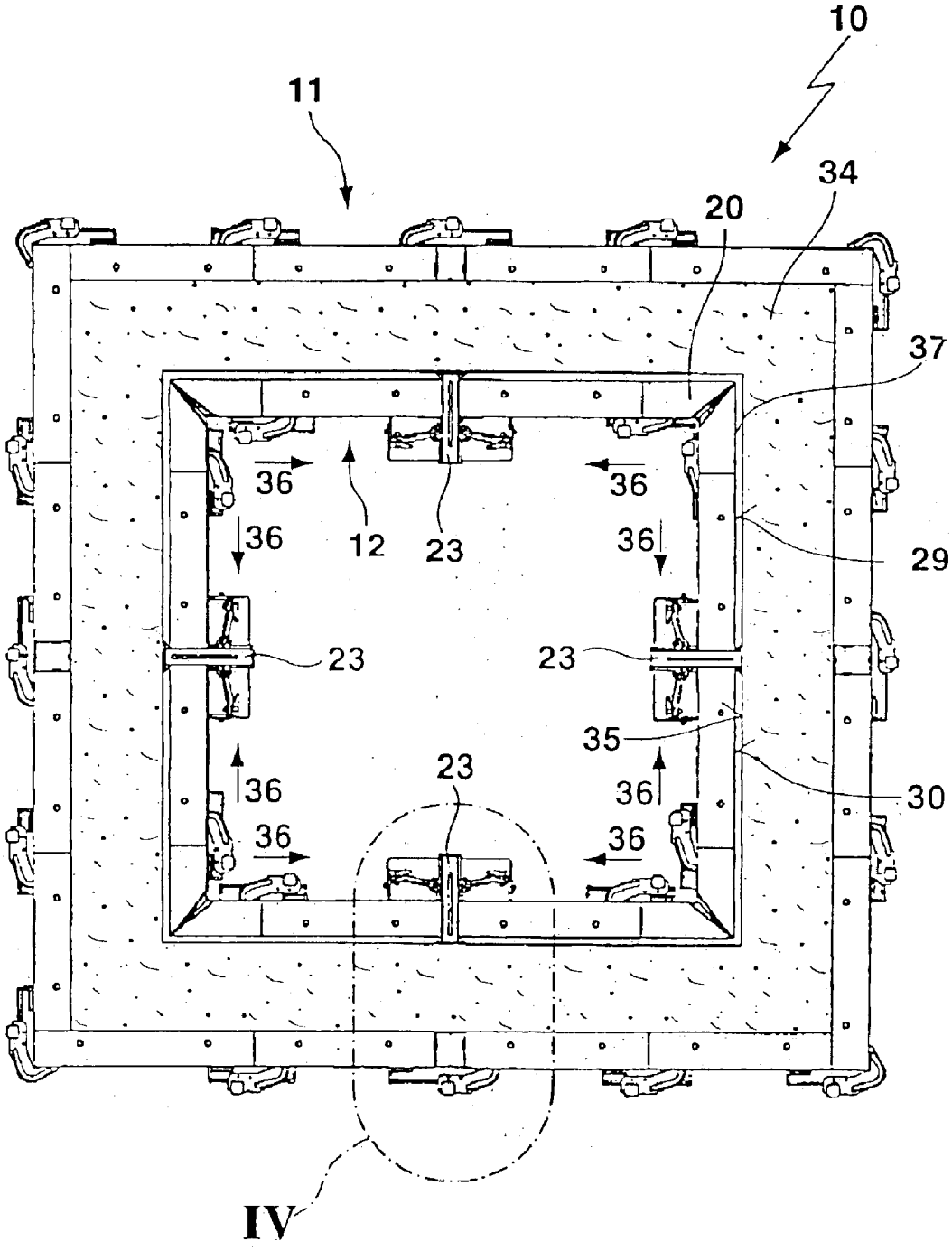
FIG. 3 shows a top view of an inventive device which is used as shaft formwork in the dismantled state.

FIG. 3 shows a dismantled shaft formwork 10. A concreted shaft section 34 was produced. The jacket tubes were removed and the compensating elements 23 were lifted from the plane of the drawing to such an extent that they could completely release the inner shaft formwork 12 from the bordering concreted surface 35. Through lifting of the compensating elements, the inner shaft formwork 12 was pulled together in the directions of arrows 36 to such an extent, i.e. reduced in size, that a gap 37 between the concreted surface 35 and the formwork surfaces 29, 30 is produced which is formed also in the region of the corner formwork elements 20. IV shows in a dash-dotted circle a section which is described in FIG. 4.

Figure 4:
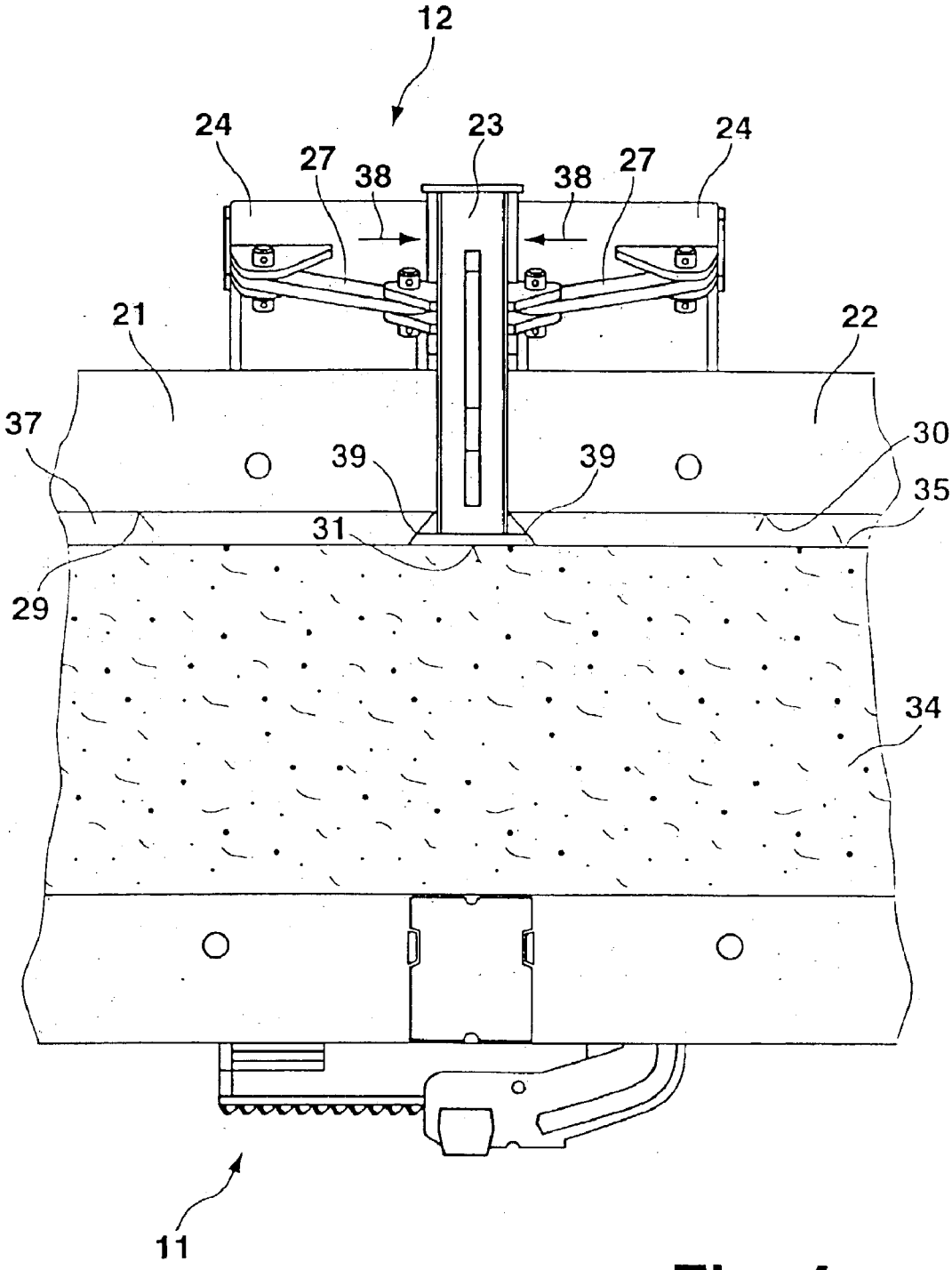
FIG. 4 shows a sectional enlargement of FIG. 3 in the region IV with an inventive compensating element.

FIG. 4 shows a section of the outer shaft formwork 11 and the inner shaft formwork 12 on an enlarged scale of FIG. 3 in the region IV.

The formwork elements 21, 22 are separated from the concreted shaft section 34 via the gap 37. The compensating element 23 still contacts the concreted surface 35 via the formwork surface 31, and the formwork surfaces 29, 30 are set back relative to the formwork surface 31. The compensating element 23 was lifted from the plane of the drawing to such an extent that the rod assembly 27 has moved the housings 24 together in the direction of arrows 38, wherein the housings 24 are rigidly connected to the formwork elements 21, 22.

Figure 5:
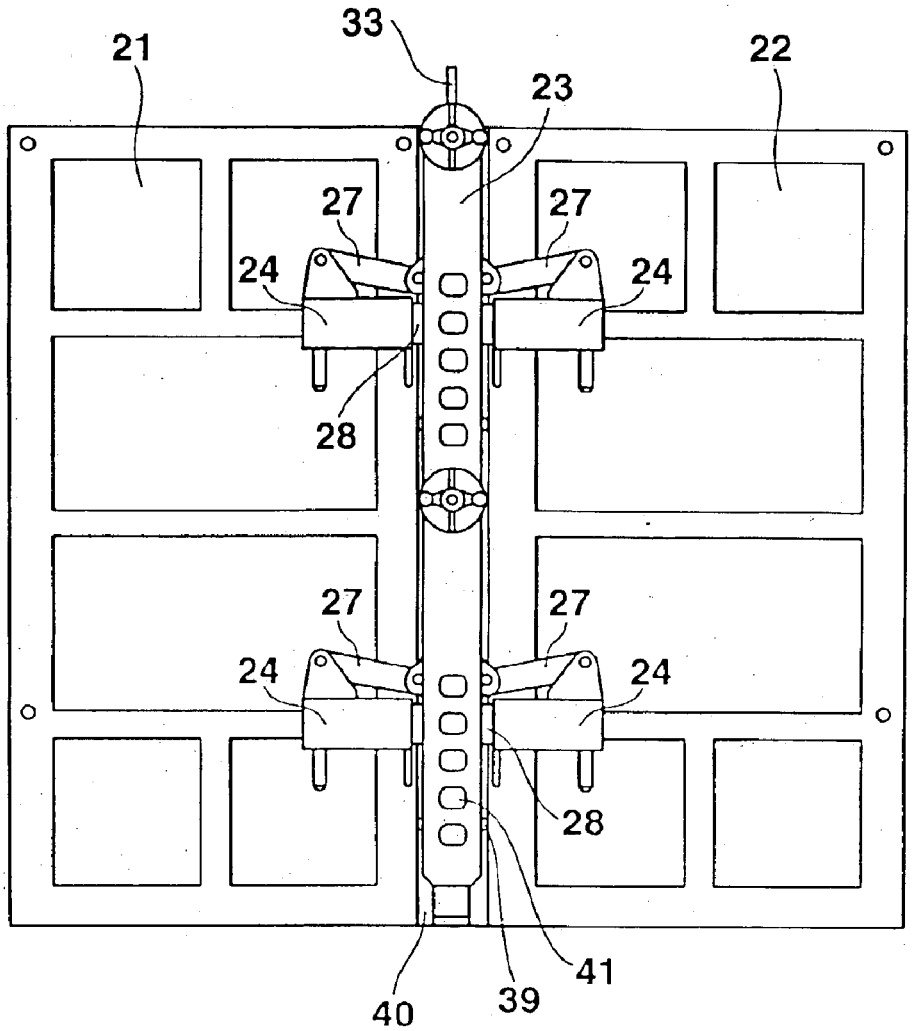
FIG. 5 shows a rear view of an inventive device with a compensating element and a first and second formwork element connected thereto, wherein the compensating element is shown in its encased state.

FIG. 5 shows the inventive formwork mounting and dismantling device with a compensating element 23 which is connected to a formwork element 21 and a formwork element 22. The rear view shows a simplified representation of the construction of the formwork elements 21, 22 and the compensating element 23. The compensating element 23 is shown in the mounted position, i.e. the formwork elements 21, 22 are pulled tightly to the edges of the formwork surface 31 of the compensating element 23. The rod assembly 27 is in a position in which it pulls apart the housings 24 along the tubes 28 and subsequently pull them together so that the formwork surfaces 29, 30, 31 (shown in FIG. 6) abut flush, tightly and flatly. The upper end of the compensating element 23 shows the bracket 33 via which the compensating element 23 can be lifted. When the formwork is in the mounted position, the compensating element 23 stands on the same basis on the same level as the formwork elements 21, 22. The rear side 40 of the formwork surface 31 shows the locally formed leading slopes 39. The formwork elements 21, 22 are displaced via these leading slopes 39 to the concreting position. Openings 41 disposed on top of each other are formed on the surface of the compensating element 23 for engagement of tools by means of which the compensating element 23 can be displaced into the position shown in the figure if the natural weight of the compensating element 23 is insufficient. Moreover, the compensating element 23 can be moved manually into a formwork dismantling position.

Figure 6:
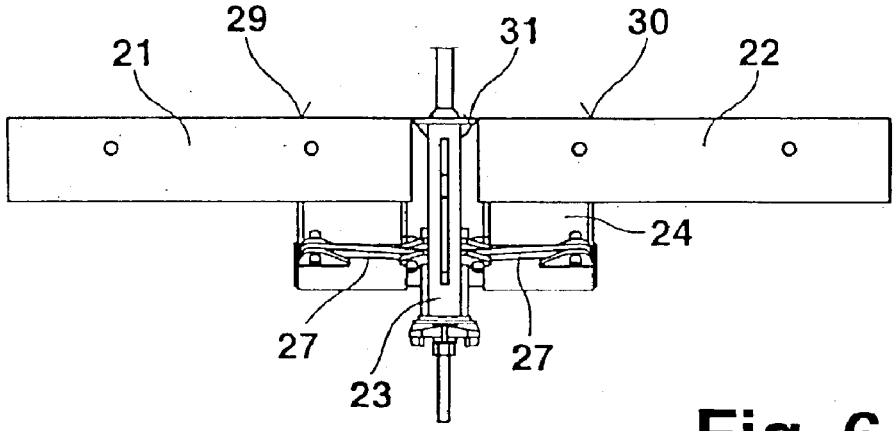
FIG. 6 shows a top view onto an inventive device of FIG. 5.

FIG. 6 shows the arrangement of FIG. 5 in top view showing that the housings 24 on the compensating element 23 have been moved via the rod assembly 27 into a position in which the formwork element 21, the formwork element 22 and the compensating element 23 abut flush and tightly via their formwork surfaces 29, 30, 31.

Figure 7:
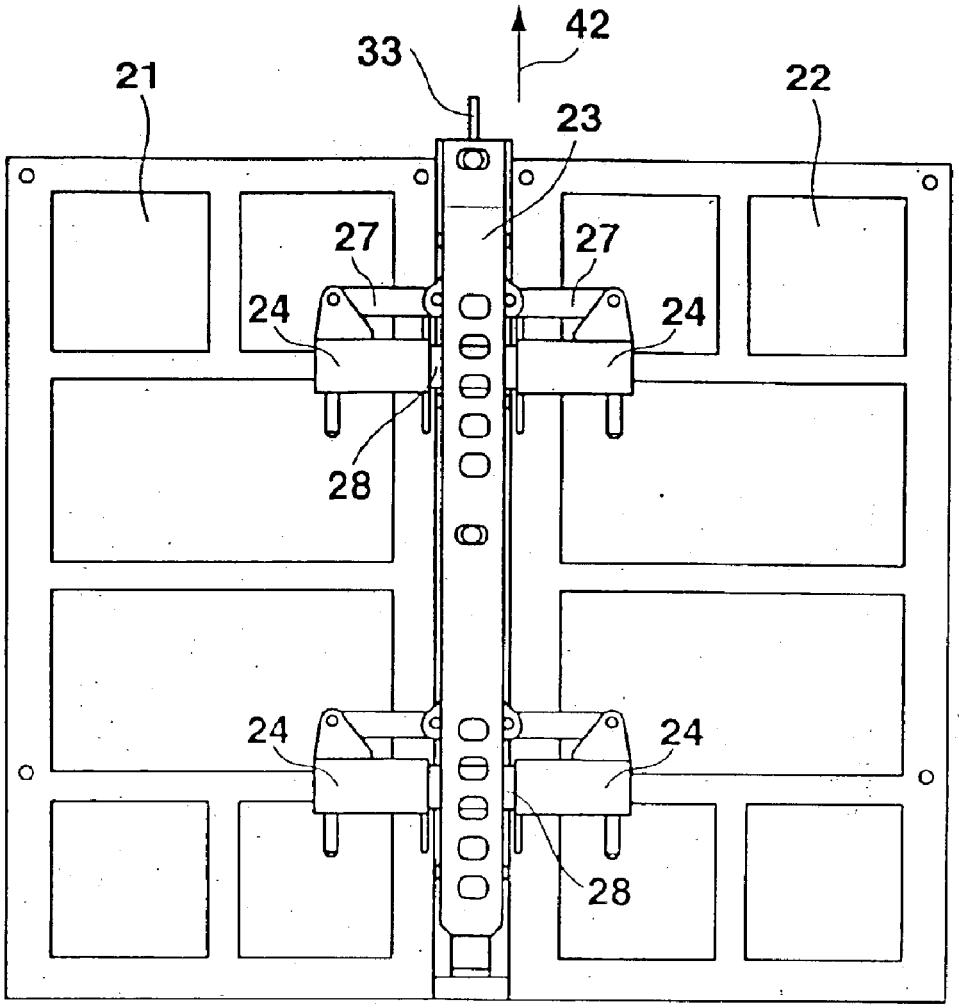
FIG. 7 shows a rear view of an inventive device with a compensating element and a first and second formwork element wherein the compensating element is in a partially dismantled position in which the formwork surface of the compensating element is spaced apart from the concreted surface and the formwork surfaces of the first and second formwork element abut the concreted surface.

FIG. 7 shows the compensating element 23 and the connected formwork elements 21, 22 at the beginning of formwork dismantling. The compensating element 23 was slightly lifted relative to the formwork elements 21, 22 against gravity in the direction of arrow 42 via the bracket 33. The position of the rod assembly 27 on the housings 24 has changed without displacing the housings 24 relative to the tube 28. The rod assembly 27 and the fastening of the housings 24 to the formwork elements 21, 22 have a play of such a high degree that in the position of the compensating element 23 shown in FIG. 7, displacement of the formwork elements 21, 22 in a horizontal direction is not yet possible.

Figure 8:
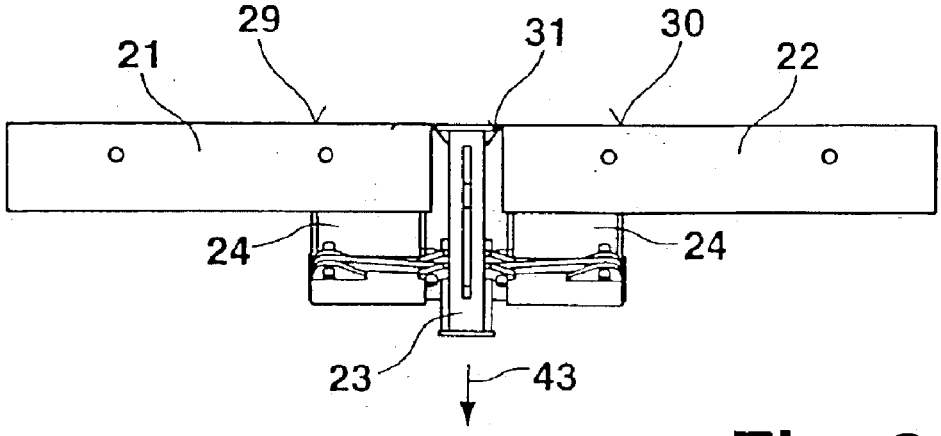
FIG. 8 shows a top view onto the inventive device of FIG. 7.

FIG. 8, showing a top view of the elements of FIG. 7, shows that the compensating element 23 is set back relative to the formwork surfaces 29, 30 in the direction of arrow 43. By lifting of the compensating element 23 the formwork surface 31 was removed from a surface to be concreted not shown in the figure, and in the position shown in FIG. 8, the formwork surface 31 is set back relative to the plane formed by the formwork surface 29, 30.

FIG. 9 shows the inventive formwork mounting and dismantling device having the compensating element 23 and formwork elements 21, 22 connected therewith when the formwork is completely dismounted. The compensating element 23 was lifted further in the direction of arrow 44 by the bracket 33 such that the rod assembly 27 displaces the housings 24, which are rigidly connected to the formwork elements 21, 22 via e.g. bolt connections, towards one another. The housings 24 completely cover the tube extending in the housings 24 such that it is no longer visible. The formwork elements 21, 22 are pulled together. Their total width in combination with the compensating element 23 has been reduced.

FIG. 10 shows a top view of the arrangement of the compensating element 23 with the formwork elements 21, 22 of FIG. 9. The formwork surface 31 of the compensating element 23 is loosely and resiliently supported on the concreted surface 35. The formwork surfaces 29, 30 of the first and second formwork element 21, 22 are set back relative to the concreted surface 35 and the formwork surface 31. The housings 24 have been displaced with the formwork elements 21, 22 to the side faces of the compensating element 23 by further lifting the compensating element 23 against gravity.

FIGS. 11 through 15 show again highly schematically the functional process of the inventive formwork mounting and dismantling device on a concreted wall section 46. Formwork elements 47, 48 and a compensating element 49 abut flush with their formwork surfaces on the directly bordering concrete surface. At the start of the dismantling process, the compensating element 49 is displaced such that it is set back relative to the concreted surface and is released from the concreted surface. Towards this end the formwork elements 47, 48 are pushed to the concreted surface 46 in the direction of arrows. The compensating element 49 is displaced in the direction of arrow against the direction of force with which the formwork elements 47, 48 abut the concrete surface 46 (FIG. 12). In a subsequent motion during dismantling the formwork, the compensating element 49 is displaced again onto the concreted surface 46, is supported there and presses the formwork elements 47, 48 in the direction of the indicated force arrows (FIG. 13). In this motion, the formwork elements 47, 48 are peeled off from the concreted surface 46 such that the formwork elements 47, 48 do no longer adhere to the concreted surface 46.

FIG. 14 shows the final state after peeling off during the dismantling process. The compensating element 49 still abuts the concreted surface 46 whereas the formwork elements 47, 48 are completely removed from the concreted surface 46. If the compensating element 49 is further displaced from the plane of the drawing as shown in FIG. 15, the formwork elements 47, 48 are pulled together in the direction of arrows behind the compensating element 49. The dimensions of the arrangement which consists of a formwork element 47, a compensating element 49 and a formwork element 48 have been reduced in size. At the same time, the formwork elements 47, 48 are completely removed from the concreted surface 46, and the compensating element 49 still abuts with resilient touching contact the concreted surface 46.

FIG. 16 shows a section of a compensating element in the region of an opening 32 which is penetrated by a tube 28 which is guided with its two ends in one housing each which is rigidly connected to bordering formwork elements. The opening 32 is designed as an elongated hole with a slight slope and a crank contour 51. A side face reinforcement 52 is formed in the region of the crank contour to permit that the compensating element can bear larger forces in this region. The tube 28 is shown in a first position in the opening 32 in which the formwork surface 31 is removed from the concreted surface and the directly bordering formwork surfaces of the formwork elements still abut the concreted surface. If the compensating element is further lifted in the direction of arrow 53, the tube 28 is moved in a position 28 in which the compensating element is again moved to the concreted surface via the formwork surface 31, and the formwork surface 31 is supported on the concreted surface. In the position of the tube denoted 28', the formwork elements bordering a compensating element are not yet pulled towards each other. The bordering formwork elements are pulled towards each other only after further lifting of the compensating element in the direction of arrow 53, and the tube is moved to a position 28". In the position of the tube in the final position 28", the formwork dismantling process is completely finished. The formwork elements have been pulled together to such an extent that they can be removed from a shaft.

A compensating element 23 is permanently connected to a first formwork element 21 and a second formwork element 22 wherein the compensating element 23 has openings 32 formed like elongated holes in its side along the axial direction, wherein the openings 32 are each penetrated by a tube 28 which terminates in one housing 24 each on both sides of the compensating element 23. The housings 24 can be displaced along the tube 28 and moved via a rod assembly 27. If the compensating element 23 is displaced into a formwork dismantling position, first the compensating element 23 is released from the concreted surface and subsequently, the compensating element 23 is put against the concrete surface with the formwork surface 31 again, and during further displacement of the compensating element 23 peels off the formwork elements 21, 22 from the concreted surface such that neither the compensating element 23 nor the formwork elements 21, 22 adhere to the concreted surface. If the formwork elements 21, 22 and the compensating element 23 are free from adhesion to the concreted surface, the formwork elements 21, 22 which directly border the compensating element 23 are pulled together behind the formwork surface 31 of the compensating element 23 in a further displacement of the compensating element 23. In this state, the first and second formwork elements 21, 22 are spaced apart from the concreted surface and the compensating element 23 abuts the concreted surface via a resilient touching contact. If the first and second formwork elements 21, 22 shall be brought into a formwork mounting position through the inventive device, the compensating element 23 is displaced against the displacement into a formwork dismantling position, and the formwork elements 21, 22 which directly border the compensating element 23 are pushed apart sliding down via the leading slope 39 to such an extent that they form a formwork plane which is composed of the formwork surfaces 29, 30 and 31. In this position (see FIG. 6), the formwork elements 21, 22 are pulled tightly to the edges of the formwork surface 31 of the compensating element 23 by the rod assembly 27 again.

What is claimed is:

1. A device for mounting and dismantling of at least one of inner shaft formwork elements, the device comprising:

a compensating element (23, 49) connectable to one or both of first and second inner shaft formwork elements (21, 22; 47, 48), the compensating element (23, 49) including means for moving the inner shaft formwork elements (21, 22; 47, 48) relative to one another over a certain distance;

means for displacing inner shaft formwork surfaces (29, 30) of one or both of the inner shaft formwork elements (21, 22; 47, 48) at least partially behind a compensating element formwork surface (31) during displacement of the compensating element (23; 49) into a formwork dismantling position;

means for pulling together the inner shaft formwork elements (21, 22) behind the compensating element formwork surface (31) during displacement of the compensating elements (23; 49) into the dismantling position;

means for moving apart the inner shaft formwork element (21, 22; 47, 48) into a predetermined formwork position during displacement of the compensating element (23; 49) into a formwork mounting position; and means for moving the compensating element formwork surface (31) behind the formwork surface (29, 30) of one or both of the inner shaft formwork elements (21, 22, 47, 48) during displacement of the compensating element (23, 49) into the formwork dismantling position and means for moving the compensating element formwork surface (31) into a plane of the formwork surface (29, 30) of one or both of the formwork elements (21, 22, 47, 48) inner shaft during displacement of the compensating element into the formwork dismantling position.

2. The device according to claim 1, wherein the compensating element (23; 49) has the shape of a pillar with several openings (32) disposed along an axial direction and has the compensating element formwork surface (31) facing a formwork plane, and on a surface opposite the compensating element formwork surface (31) several openings (41) are arranged on top of each other for engagement of a tool.

3. The device according to claim 2, wherein the openings (32) are formed as crank guidances having the shape of elongated holes wherein the openings (32) are penetrated by a tube (28) each tube (25) being displaceably guided in a housing (24) on both sides of the compensating element (23), wherein the housing (24) is rigidly connected to the formwork elements (21, 22) and wherein a rod assembly (27) is hinged to the housing (24) and to the compensating element (23).

4. The device according to claim 3, wherein the rod assembly (27) is designed such that, during motion of the compensating element (23) into a formwork dismantling position, the inner shaft formwork elements (21, 22) are pulled together only when the inner shaft formwork elements (21, 22) have been peeled off from a concreted surface (35) over at least 40% of formwork surface.

5. Device according to claim 1, further comprises a bracket (33) with an opening the bracket being disposed at an upper end of the compensating element (23).

6. Device according to claim 1, further comprising an inner shaft formwork (12) formed of four corner formwork elements (20) connected to inner shaft formwork elements (21, 22) bonding a compensating element (23) approximately in the center of a shaft wall to be concreted each such that four mutually opposite compensating elements (23) are disposed in order to providing a square or rectangular inner shaft.

* * * * *